United States Patent [19]

Brown

[11] 4,217,986

[45] Aug. 19, 1980

[54] INVENTORY RESTRAINING DEVICE FOR MERCHANDISE DISPLAY HOOK

[76] Inventor: Donald M. Brown, 3960 Wilshire Blvd., Los Angeles, Calif. 90010

[21] Appl. No.: 903,889

[22] Filed: May 8, 1978

[51] Int. Cl.[2] ..... A47F 7/00

[52] U.S. Cl. ..... 211/57.1; 24/257; 211/54.1; 248/220.4

[58] Field of Search ..... 24/257, 255 R, 137 R, 24/138; 248/220.4, 220.3, 221.1, 221.2, 223; 211/49 S, 59.1, 50, 57.1, 51, 49 D, 54.1, 123, 124

[56] References Cited

U.S. PATENT DOCUMENTS

| | | | |
|---|---|---|---|
| 1,868,726 | 7/1932 | Collier | 24/138 R |
| 2,626,061 | 1/1953 | Girouard | 211/59.1 |
| 3,204,313 | 9/1965 | See | 24/137 R |
| 3,308,961 | 3/1967 | Chesley | 211/49 D |
| 3,353,567 | 11/1967 | Isreeli | 24/257 R X |
| 3,494,583 | 2/1970 | Parr | 24/257 R X |
| 3,780,873 | 12/1973 | Silva | 211/49 D |
| 4,013,252 | 3/1977 | Braverman | 248/220.4 |

*Primary Examiner*—Philip C. Kannan
*Attorney, Agent, or Firm*—Smyth, Pavitt, Siegemund, Jones & Martella

[57] ABSTRACT

A generally horseshoe shaped inventory restraining device of a unitary and resilient construction comprising two arms extending from a base and having inner walls which define a longitudinally extending re-entrant cavity therebetween for clipping onto and tight securement to a rod-like merchandise display hook. A method is presented for using the device in conjunction with the merchandise display hook.

3 Claims, 7 Drawing Figures

INVENTORY RESTRAINING DEVICE FOR MERCHANDISE DISPLAY HOOK

BACKGROUND OF THE INVENTION

The present invention relates to inventory restraining devices to be used in connection with display apparatus for merchandise of the type carried by cards and the like.

More particularly, the present invention relates to a generally horseshoe shaped inventory restraining device of a unitary and resilient construction comprising two arms extending from a base and including inner walls defining a longitudinally extending re-entrant cavity therebetween for clipping onto and tight securement to a rod-like merchandise display hook, and method of using the same.

Display apparatus used in connection with a variety of merchandise and particularly, for use with merchandise carried by cards and the like, are well known in the prior art. These devices are generally used as vehicles for promoting the sale of certain types of products in an attractive and organized manner. In addition, these devices provide a more efficient means for monitoring the flow of inventory because of the neat and orderly fashion in which they are able to maintain the stock. Often, however, as a result of consumer mishandling of the displayed merchandise, previously neatly stocked items are caused to be moved aimlessly about i.e., either pushed rearwardly along the display hook or hurridly placed upon a hook containing other types of products only. The resulting display setting, thus, becomes completely disrupted and is caused to appear, to a large extent, void of stock altogether. Prospective customers usually find this sort of display vastly unappealing, which response will inevitably affect the profits derived from the particular merchandise involved. The storekeeper is, therefore, forced to keep a constant and tiresome vigil over the status of the display in order to ensure its continual effectiveness as an appealing means to present his products for sale to the public.

Until now, no device or method of the prior art has achieved a solution to these problems with any degree of success.

The device of the present invention, however, does solve the problems substantially ignored by the prior art. Through the use of the device of the present invention, and the method of using the same, it is now possible to maintain a more attractive display, preserve a full look with reduced inventory, and more efficiently control inventories at the store level. These factors, in turn, enhance sales.

SUMMARY OF THE INVENTION

In accordance with the present invention, a generally horseshoe shaped inventory restraining device of a unitary and resilient construction includes two arms which extend from a base. The arms include inner walls which define a longitudinally extending re-entrant cavity therebetween for permitting the device to firmly clip onto and tightly secure itself to a rod-like support hook for displaying merchandise and particularly, for displaying products attached to merchandise carrying cards and the like.

The re-entrant cavity defined by the arms extends in the direction of the longitudinal axis of the device. The inner walls extend in a generally concave manner away from the base and then somewhat convexly outwardly from each end of the concave extension to become increasingly spaced apart from each other. The space formed at the end of the convex extensions opposite the end where the convex and concave extensions meet is generally equal to the distance between the inner walls of the concave extension but equal to approximately twice the width measured at such meeting point.

A method for using the device of the present invention includes clipping the same firmly to a rod-like hook for displaying merchandise usually at some point rearward of the last item of merchandise supported thereon, the first item naturally being the one nearest to the forward section of the display. The device is then slipped deliberately forward to contact the rear side of the last item which, in turn, contacts the immediately forward item, and so on, until all the items having been placed on the hook are arranged in close relation at the forward most portion of the display as is possible.

These and other features and advantages of the invention will become more apparent with a discussion of preferred embodiments and reference to the associated drawing.

DESCRIPTION OF PREFERRED EMBODIMENTS

Figure 2:
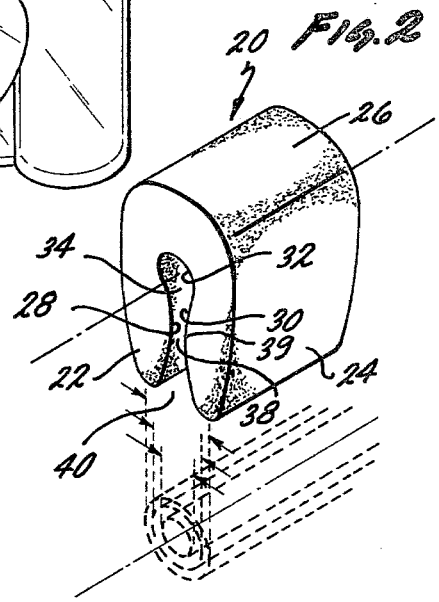
FIG. 2 is a perspective view of the device of the present invention showing its position just prior to clipping the same onto the rod-like hook member of the merchandise display apparatus.
Figure 3:
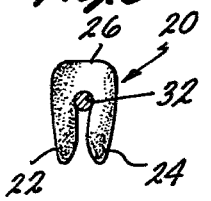
FIG. 3 is a plan view of the device of the present invention showing it in clipped on position.
Figure 4:
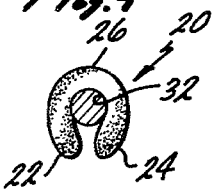
FIG. 4 is a plan view of an alternative embodiment of the device of the present invention showing it in clipped on position.

The inventory saving clip of the present invention is best illustrated in FIG. 2 and is designated by the reference numeral 20. The clip 20 has arms 22 and 24 extending from a base 26. Arms 22, 24 define respectively inner walls 28 and 30 which, in turn, define a longitudinally extending cavity or channel 32. The cavity 32 is of a generally concave shape at region 34 where it is closest to the base 26, but becomes increasingly more convex in design along region 39 as it moves away therefrom. The inner walls 28 and 30 approach each other most closely at portion 38 of the cavity 32. The widest portion of the cavity 32 is located at its outermost opening 40. Opening 40 is generally a bit larger in width than the diameter of the circular region 34.

The clip 20 is usually constructed of a resilient material such as rubber or flexible plastic, although other resilient material compositions may be used. It is this resiliency or flexibility which permits the arms 22, 24 to spread apart sufficiently to receive the rod-like hook 14 therebetween and then enable the same to grip the rod in tight securement. The opening 40 is shaped and sized to permit easier application of the clip 20 onto the rod 14. The circular region 34 of cavity 32 is shaped and sized to receive the rod 14 snugly and then retain a firm grasp thereon once the clip is maneuvered into its proper position.

Generally, the dimensions of the preferred embodiment of clip 20 range as follows: length A is approximately one-half inch; height B is approximately one-half inch; and width C, at the widest point of clip 20, is approximately one-half inch. Any of these foregoing dimensions may be modified, when necessary, for adaptation to rod supports of varying sizes and shapes.

Before explaining the method of use of the device of the present invention, it is necessary to understand first the circumstances surrounding its use.

Merchandise 18, 23 and 31 are often arranged for sale to the customer on a merchandise display apparatus comprised generally of board 10, brace supports 12 and rod-members 14. Board 10 is typically a peg board containing numerous holes 11 for receiving arms 13, 15 of brace 12. Several rod members 14 may be utilized depending upon the size of the display and number of products to be hung thereon. Products may be hung for display from the rod 14 by means of inserting the former through hole 21 placed in the product wrapper or a special card 17, sometimes referred to as a merchandise carrying card, attached to the product. It should also be understood that rod members of the type described herein may be used in conjunction with other means for support than the aforementioned peg board 10.

Often, there are several varieties of products held by a display unit at any one time. The fact that products range in several sizes and shapes makes it possible for one rod member 14 to hold few items of one product type while another similarly sized member may hold many more products of a different type. A prime example is indicated by a comparison of merchandise 18 and 31 displayed in FIG. 1. Removal of a larger product for purchase, such as merchandise 31, by a customer will often leave a much larger void on its respective rod 14 than the removal of a single smaller or thinly packaged product, such as merchandise 18, from another similar rod member. As a result, the display may appear sparse in some sections while full in others. This occurrence detracts from the overall attractiveness of the display, which, in turn, could have a drastic effect upon the buying habits of the prospective customer. Another problem that concerns all merchants is the difficulty in maintaining the continuous neat appearance of the display after it experiences several hours of consumer handling.

Figure 1:
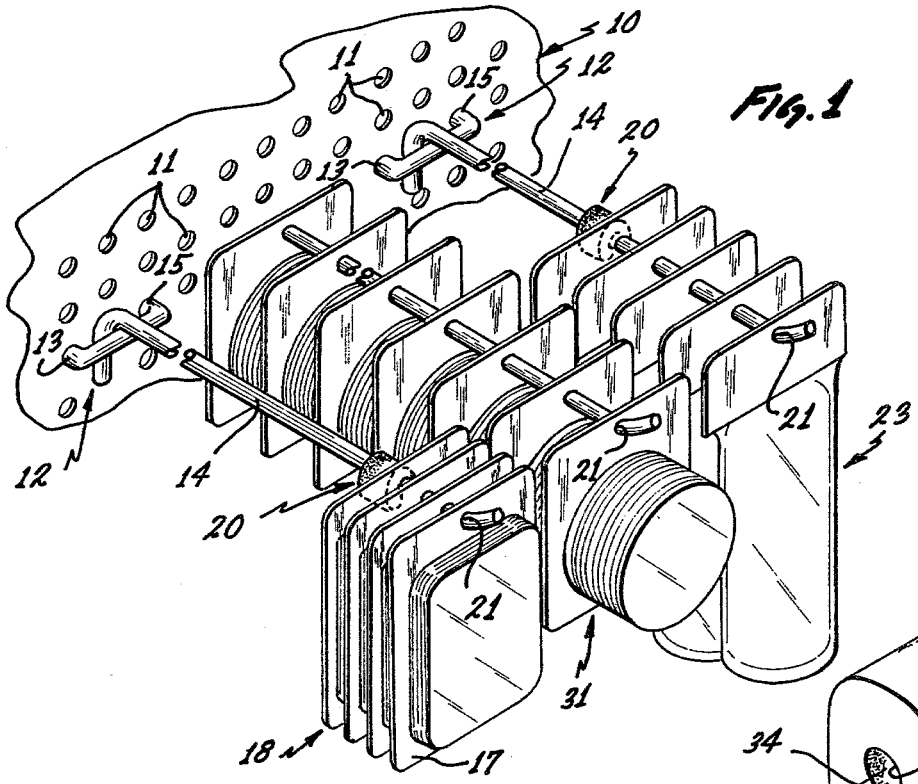
FIG. 1 is a perspective view of the device of the present invention used in conjunction with a merchandise display apparatus.
Figure 5:
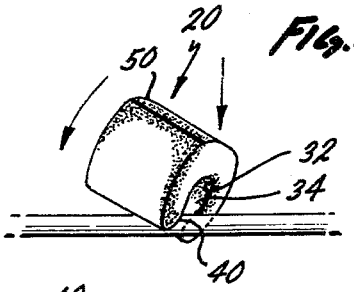
FIG. 5 is a perspective view of the device of the present invention showing one method of clipping the same onto the rod-like hook member.
Figure 6:
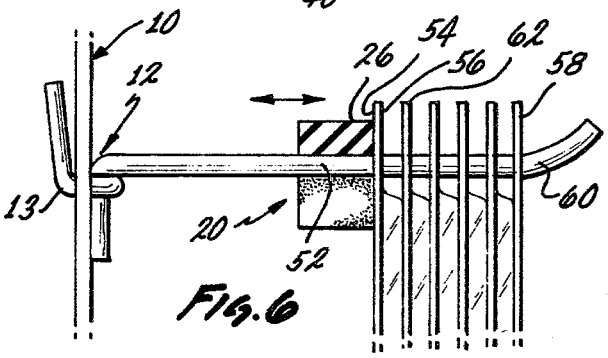
FIG. 6 is a side elevational view partially in cross section of the invention shown in FIG. 1; and, FIG. 7 is a perspective view of the device of the present invention showing the same clipped onto an alternative type of rod-like hook member of a merchandise display.
Figure 7:
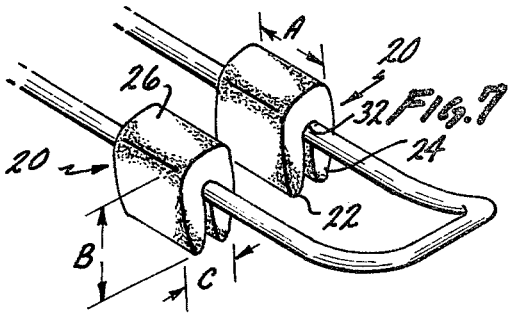

The manner in which clip 20 is applied to a rod support or hook of a display of the type described hereinabove and indicated in FIG. 1 is shown in FIG. 2 and FIG. 5. Clip 20 at opening 40 is placed on rod or hook 14 at approximately a 45° angle and firmly pressed thereon to enable rod 14 to be received within the convex extension 39 of cavity 32. After the initial reception of rod 14 by the convex extension 39, the elevated portion 50 of clip 20 is then pressed downwardly to receive more of rod 14 into the remaining and vacant portion of cavity 32. Clip 20 is then further pressed towards rod 14 until the latter is fitted as snuggly and firmly as possible into concave region 34 of cavity 32. Typically, the attachment of clip 20 to rod 14 will occur at a point 52 rearward of the merchandise on display. If no merchandise is being displayed at the time, clip 20 may be placed at any point along rod 14 and later adjusted therealong after the amount of products to be hung can be determined.

Once placed on rod 14, it is only necessary to slide clip 20 forwardly to contact the rear side 54 of the last item 56 displayed thereon, the first item 58 being the nearest to the forward section 60 of the display. Last item 56 is in turn moved to contact item 62 immediately forward thereof, and so on, until all of the items having been placed on rod 14 are neatly arranged in close relation at the front of the display. Thereafter, whenever an item is removed for purchase, the remaining products will continue to give the impression of a full stock and retain their neat, organized and appealing display appearance. By sliding clip 20 forward from time to time, it is possible to maintain the display's initial attractiveness as though the stock had never been depleted.

An alternate method of use of clip 20 involves the positioning of the same onto rod 14 and, thereafter, not having to periodically adjust the clip forward as inventory is removed for purchase. Naturally, the fixed position maintained by clip 20 will serve as a barrier to prevent merchandise from being jostled rearwardly along rod 14. This, in turn, will ensure a fuller inventory appearance towards the front portion of the display for a longer period of time and result in a substantial savings of man-hours that ordinarily would have been required to attend to the frequent replenishment of the inventory.

As an inventory control maintenance device, clip 20 is extremely effective. By preventing rearward movement of the merchandise, empty display rods will no longer invite impatient and inconsiderate customers to hang thereon "change of mind" merchandise which had been previously displayed and stocked elsewhere.

The present invention is thus most effective in providing the storekeeper with the following benefits: inventory control; a full look with reduced inventory; more attractive display appearance; easily adjustable inventories; a device which will fit all known types of merchandise display rod supports or hooks; easy installation; and low cost. The end result is, therefore, greater profits for the seller, lower prices for the customer.

What has been described are preferred embodiments which modifications and changes may be made without departing from the spirit and scope of the accompanying claims.

I claim:

1. Apparatus for displaying merchandise of the type wherein the merchandise is attached to a card having a hole through it, said apparatus comprising in combination:

a base;

a rod having a back end attached to said base, said rod extending from the base to a front end and passing through a hole in a card; and, a unitary restraining device of resilient material of a uniform horseshoe-shaped cross section consisting of two arms extending from a body a distance exceeding the diameter of the hole in the card, a re-entrant cavity being defined between said arms, the closest spacing between said arms being less than the diameter of said rod, whereby when a central portion of said rod is forced into removable engagement with the re-entrant cavity defined between the arms a resilient restoring force is produced causing the arms to grip said rod so tightly that said restraining device can be moved along said rod only by a force deliberately applied to said restraining device by an operator;

said restraining device thusly removably engaging said rod at a position between the card and said base to prevent casual applied forces weaker than the deliberately applied force from moving the card along said rod toward the back end of said rod.

2. Apparatus for displaying a piece of merchandise, comprising in combination:

a card to which the piece of merchandise is attached, said card having a hole through it;

a base;

a rod having a back end attached to said base, said rod extending from the base to a front end and passing through the hole in said card; and, a unitary restraining device of an elastomeric material of a uniform horseshoe-shaped cross section consisting of two arms extending from a body a distance exceeding the diameter of the hole in the card, a re-entrant cavity being defined between said arms, the closest spacing between said arms being less than the diameter of said rod, whereby when a central portion of said rod is forced into removable engagement with the re-entrant cavity defined between the arms a resilient restoring force is produced causing the arms to grip said rod so tightly that said restraining device can be moved along said rod only by a force deliberately applied to said restraining device by an operator;

said restraining device thusly removably engaging said rod at a position between said card and said base to prevent casual applied forces weaker than the deliberately applied force from moving said card along said rod toward the back end of said rod.

3. The apparatus of claim 2 wherein said restraining device is composed of rubber.

* * * * *